US009774123B2

(12) United States Patent
Sasaki et al.

(10) Patent No.: US 9,774,123 B2
(45) Date of Patent: Sep. 26, 2017

(54) ELECTRICAL CONNECTOR WITH ATTITUDE MAINTAINING STRUCTURE

(71) Applicant: Yazaki Corporation, Tokyo (JP)

(72) Inventors: Yasuhiro Sasaki, Makinohara (JP); Masayuki Yamamoto, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/963,691

(22) Filed: Dec. 9, 2015

(65) Prior Publication Data

US 2016/0172779 A1 Jun. 16, 2016

(30) Foreign Application Priority Data

Dec. 11, 2014 (JP) ..... 2014-250546

(51) Int. Cl.
*H01R 13/436* (2006.01)

(52) U.S. Cl.
CPC ..... *H01R 13/4364* (2013.01)

(58) Field of Classification Search
CPC ..... H01R 13/4362; H01R 13/4223
USPC ..... 439/595, 752, 871
See application file for complete search history.

(56) References Cited

U.S. PATENT DOCUMENTS 6,712,635 B1 * 3/2004 Nimura ..... H01R 13/641 439/352
6,827,609 B1 * 12/2004 Martin ..... H01R 13/4365 439/595
7,112,104 B2 * 9/2006 Sagawa ..... H01R 13/4365 439/595
7,114,997 B2 * 10/2006 Sagawa ..... H01R 13/4365 439/595

(Continued)

FOREIGN PATENT DOCUMENTS

JP 2002-343483 A 11/2002
JP 2006-196348 A 7/2006

(Continued)

OTHER PUBLICATIONS

Communication issued Dec. 20, 2016, issued by the Japanese Patent Office in counterpart Japanese Patent Application No. 2014-250546.

(Continued)

*Primary Examiner* — Tulsidas C Patel
*Assistant Examiner* — Marcus Harcum
(74) *Attorney, Agent, or Firm* — Sughrue Mion, PLLC

(57) ABSTRACT

A connector is provided with a connecting terminal, a connecting housing, and a front holder. The connecting housing includes a connecting terminal storing chamber, and a lance which is elastically deformable in order to store the connecting terminal into the terminal storing chamber and which is engageable with the connecting terminal in order to prevent the connecting terminal from removing when recovered from an elastic deformation. The front holder is sup- (Continued)

ported to be movable to back and forth along the insertion direction and locked on a front end of the terminal storing chamber. The front holder is moved in the opposite direction to the insertion direction to be actually locked by pressure in a state that the front holder is temporarily locked and contacted with the connecting terminal to hold in a state that the front holder is actually locked.

3 Claims, 11 Drawing Sheets

(56) References Cited

U.S. PATENT DOCUMENTS

| | | | | |
|---|---|---|---|---|
| 7,625,251 | B2 * | 12/2009 | Martin | H01R 13/4223 439/752 |
| 8,408,950 | B2 * | 4/2013 | Jeon | H01R 13/4365 439/595 |
| 8,419,471 | B2 * | 4/2013 | Suzuki | H01R 13/4223 439/595 |
| 8,678,865 | B2 * | 3/2014 | Hiraishi | H01R 13/4365 439/595 |
| 2002/0168895 | A1 | 11/2002 | Suzuki | |
| 2005/0048837 | A1 * | 3/2005 | Ichida | H01R 13/4367 439/595 |
| 2005/0148229 | A1 * | 7/2005 | Matsunaga | H01R 13/4223 439/352 |
| 2005/0176298 | A1 * | 8/2005 | Flowers | H01R 13/4365 439/595 |
| 2006/0160420 | A1 | 7/2006 | Takahashi | |
| 2008/0009171 | A1 * | 1/2008 | Tsuji | H01R 13/6272 439/352 |
| 2008/0009186 | A1 | 1/2008 | Hiramatsu | |
| 2008/0020639 | A1 * | 1/2008 | Ichio | H01R 13/4362 439/595 |
| 2009/0042438 | A1 | 2/2009 | Iwahori et al. | |
| 2012/0309219 | A1 * | 12/2012 | Hiraishi | H01R 13/4365 439/352 |
| 2013/0197440 | A1 * | 8/2013 | Zou | A61M 31/00 604/131 |
| 2014/0127928 | A1 | 5/2014 | Kida | |

FOREIGN PATENT DOCUMENTS

| | | | |
|---|---|---|---|
| JP | 3804830 | B2 | 8/2006 |
| JP | 3888172 | B2 | 2/2007 |
| JP | 4702205 | B2 | 6/2011 |
| JP | 2014-93222 | A | 5/2014 |
| JP | 2014-203633 | A | 10/2014 |

OTHER PUBLICATIONS

Office Action issued May 30, 2017 by the Japanese Patent Office in counterpart Japanese Patent Application No. 2014-250546.

* cited by examiner (Prior Art)

ELECTRICAL CONNECTOR WITH ATTITUDE MAINTAINING STRUCTURE

CROSS REFERENCE TO RELATED APPLICATIONS

This application claims priority from Japanese Patent Application No. 2014-250546 filed on Dec. 11, 2014, the entire contents of which are incorporated herein by reference.

BACKGROUND OF THE INVENTION

Field of the Invention

The invention relates to a connector.

Description of Related Art

In the structure of an ordinary connector, for example, a female terminal is inserted into a terminal storing chamber formed in a female connector housing and is stored therein while it is prevented against removal by a cantilever type lance. Further, a male terminal is inserted into a terminal storing chamber formed in a male connector housing and is similarly stored therein while it is prevented against removal by the lance. And, the male and female connector housings are fitted with each other to thereby connect the corresponding male and female terminals to each other.

For example, there is proposed a connector which prevents backlash of a connecting terminal without increasing the insertion resistance of the connecting terminal to maintain the reliability of electric connection of the connecting terminal even when vibrations are applied (see, for example, the patent document 1: JP-A-2006-196348). Specifically, a female connector includes a front holder. This front holder is supported to be movable longitudinally along the insertion direction of the terminal and is temporarily locked on the front end of a terminal storing chamber. And, when, with fitting movement with a male connector serving as a mating connector, the holder is pressed by the male connector, the front holder is contacted with a female terminal to hold the female terminal between the lance and itself, and the male connector is actually locked to the female connector.

[Patent Document 1] JP-A-2006-196348

According to a related art, in a structure where multiple female terminals are arranged horizontally side by side, when mounting front holders onto a female housing, fittings between the front holders and the female housing are set in a temporarily locked state. in this case, as shown in a female connector A' of FIG. 13, the locked attitude of the front holder 2 is not proper but, in some cases, the front holder 2' can backlash against the female housing 1'. In this case, as shown in FIGS. 14 and 15, a partial structure (detection plate 12') of the front holder 2' is situated deeper than its proper temporarily-locked state. In FIG. 13, a detection plate 12' shown on the right is situated deeper than its original position. In this state, as shown in FIG. 15, although the female terminal 4 is not inserted yet, the detection plate 12' has reached a space (bending space 28') existing above a housing lance 8'. As a result, the housing lance 8' is disabled to bend but provides an obstacle, thereby disabling insertion of the female terminal 4'. For example, in a product manufacturing process using a connector, a connector with a front holder temporarily locked is transported and delivered to a process for fitting the connector with a mating connector. In this case, it is necessary to take measures to avoid a possibility that the temporary locking of the connector can be unexpectedly turned to the actual locking thereof due to vibrations, contact with other parts or the like; and, such measures are strongly requested from a manufacturing site. In the technology disclosed in the patent document 1, measures against such problems are not considered and thus technology relating to such measures has been demanded.

SUMMARY

One or more embodiments provide a connector in which can properly maintain a temporarily locked state when a front holder and a connector housing are temporarily locked on each other.

In accordance with one or more embodiments, a connector is provided with a connecting terminal, a connecting housing, and a front holder. The connecting housing includes a connecting terminal storing chamber for storing the connecting terminal, and a lance which is elastically deformable in order to store the connecting terminal into the terminal storing chamber and which is engageable with the connecting terminal in order to prevent the connecting terminal stored in the terminal storing chamber from removing in the opposite direction to the insertion direction when recovered from an elastic deformation. The front holder is supported to be movable to back and forth along the insertion direction, and the front holder is locked on a front end of the terminal storing chamber. The front holder is moved in the opposite direction to the insertion direction to be actually locked by pressure in a state that the front holder is temporarily locked, and the front holder is contacted with the connecting terminal to hold the connecting terminal between the front holder and the lance in a state that the front holder is actually locked. The connector includes a locking structure which establishes the front holder and the connector housing as a temporarily locked state or an actually locked state before a mating connector is fitted with the connector. The connector includes an attitude maintaining structure which maintains properly the relative attitudes of the front holder and the connector housing in the temporarily locked state.

In the connector of one or more embodiments, the attitude maintaining structure may include a groove formed in any one of the front holder and the connector housing and a fitting projection formed in the other of the front holder and the connector housing and capable of fitting into the groove in the temporarily locked state or the actually locked state.

In the connector of one or more embodiments, the attitude maintaining structure may include a pressing projection formed in any one of the front holder and the connector housing. The pressing projection is pressed against the other of the front holder and the connector housing, in the temporarily locked state.

According to one or more embodiments, in a connector structured such that a front holder is locked and mounted on a connector housing, a temporarily locked state can be properly maintained when the front holder and the connector housing are temporarily locked on each other.

DETAILED DESCRIPTION

Exemplary embodiments are described with reference to the drawings.

Figure 1:
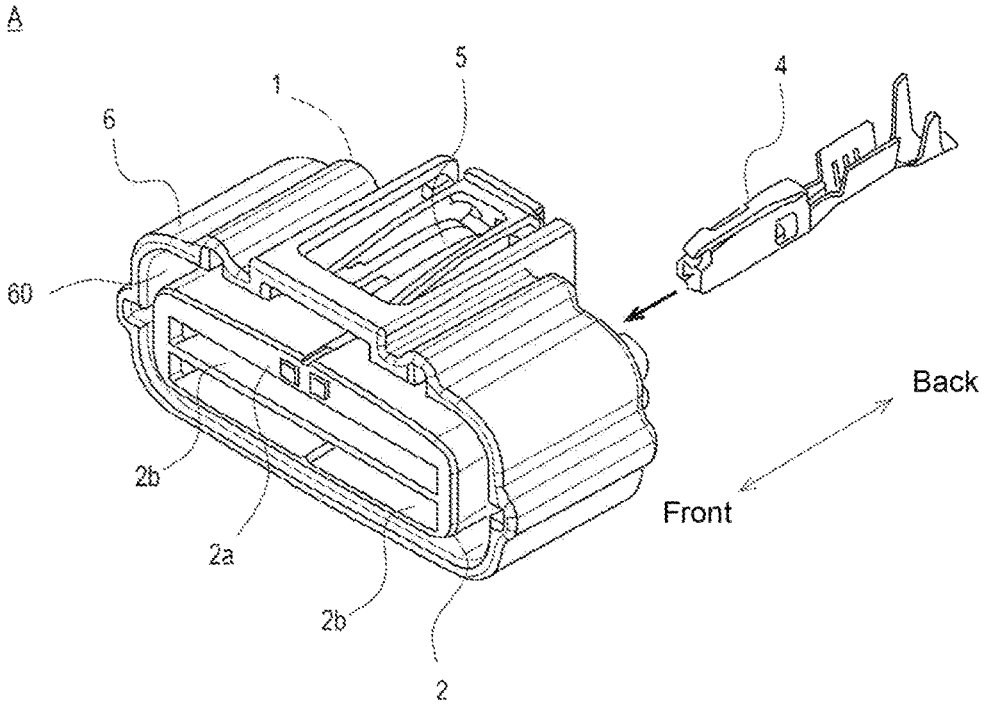
FIG. 1 is a perspective view of a schematic structure of a female connector according to an embodiment.
Figure 2:
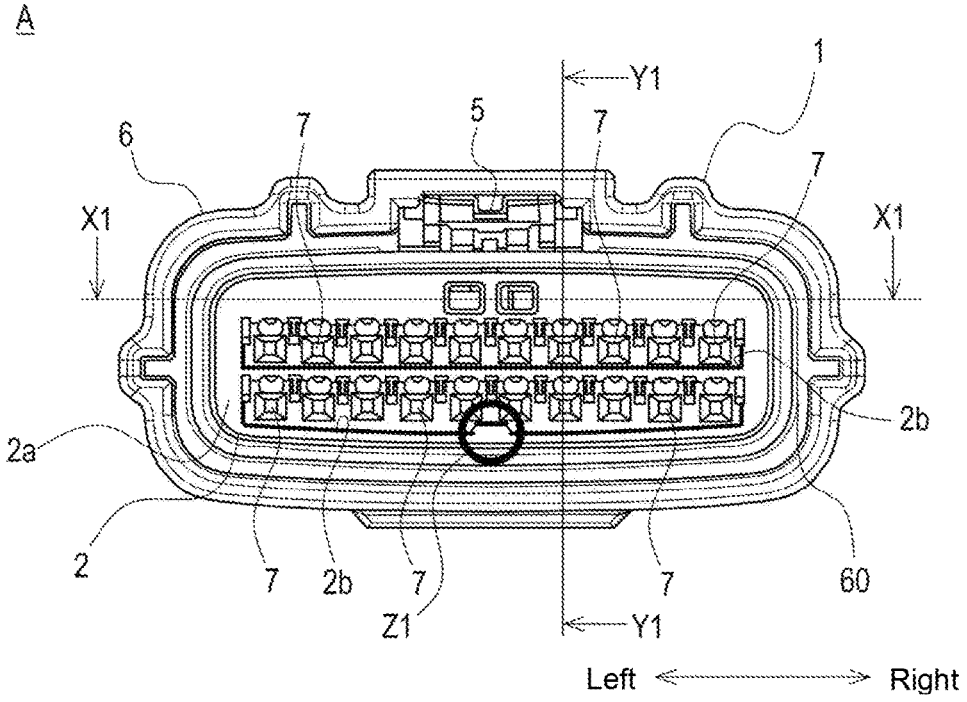
FIG. 2 is a front view of the female connector of the embodiment.
Figure 3:
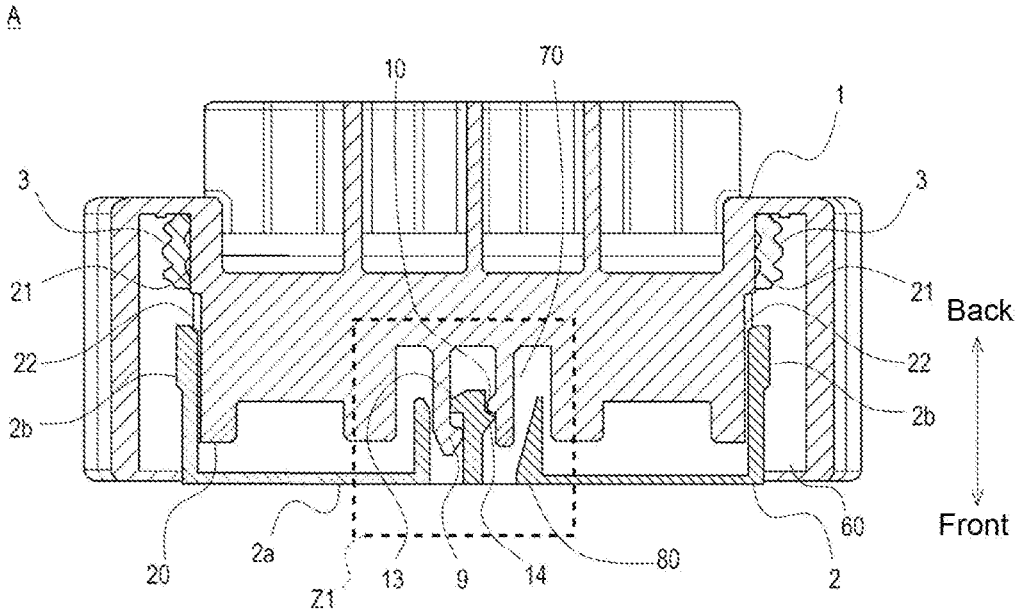
FIG. 3 is a horizontal section view of the female connector in a specific position of the embodiment.
Figure 4:
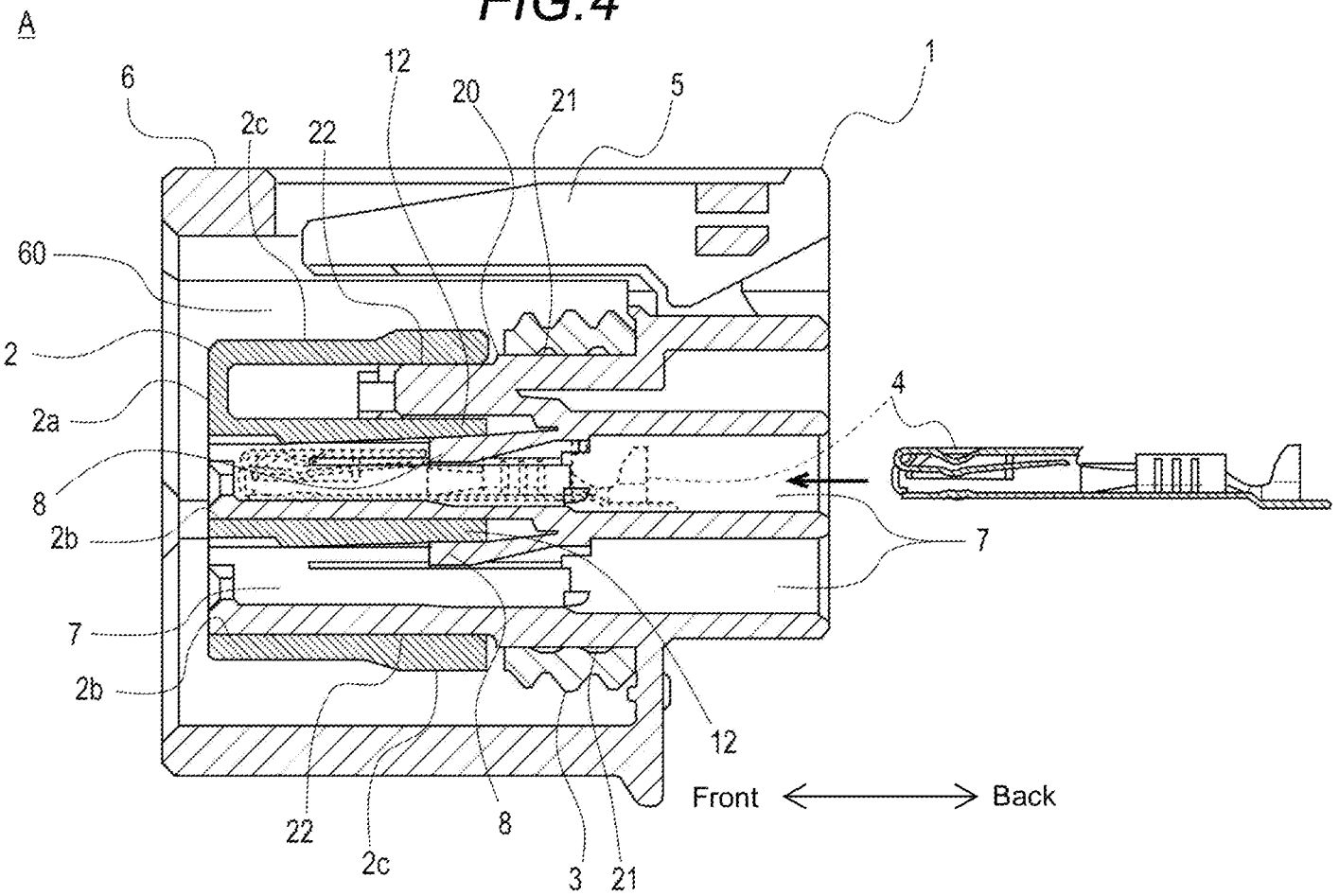
FIG. 4 is a longitudinal section view of the female connector in the specific position of the embodiment.
Figure 5:
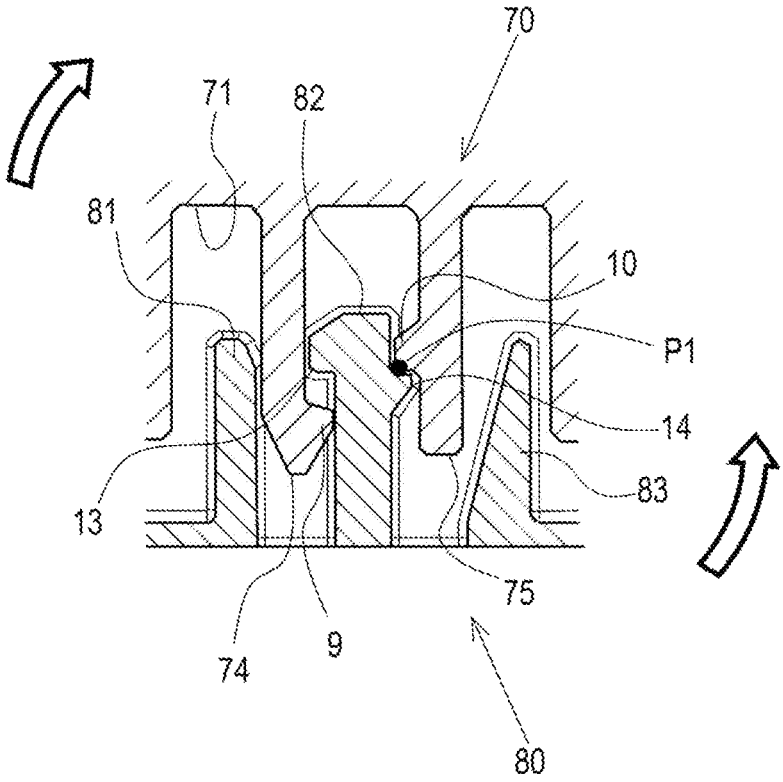
FIG. 5 is an enlarged view of the area Z1 of FIG. 3 according to the embodiment.
Figure 6:
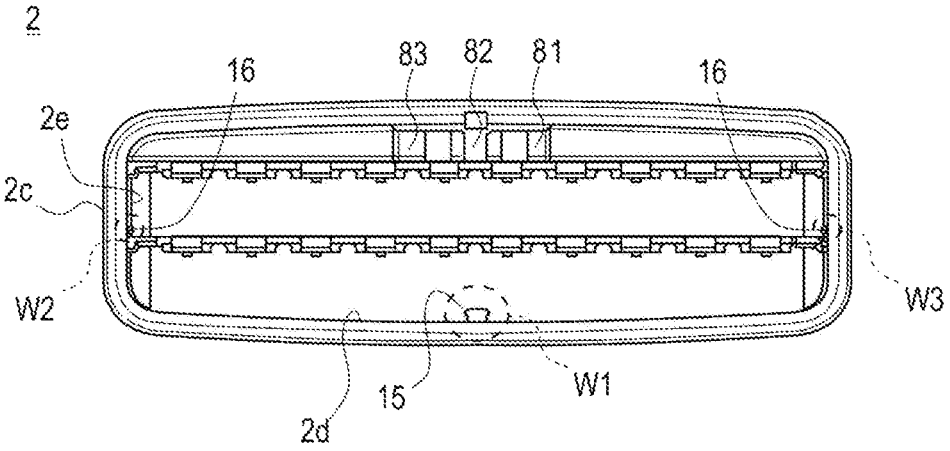
FIG. 6 is a back view of a front holder according to the embodiment.

FIG. 1 is a perspective view of a schematic structure of a female connector A according to an embodiment. FIG. 2 is a front view of the female connector A. FIG. 3 is a horizontal section view of the female connector A, taken along the X1-X1 line of FIG. 2. FIG. 4 is a longitudinal section view of the female connector A, while a female terminal 4 is additionally shown in a section view taken along the Y1-Y1 line of FIG. 2. FIG. 5 is an enlarged view of the area Z1 of FIG. 3, showing a structure for locking a female housing 1 and a front holder 2 on each other. FIG. 6 is a back view of the front holder 2.

As shown in the drawings, the female connector A includes a female housing 1, a front holder 2, a packing 3 and a female terminal 4. Although details are described later, the front holder 2 is stored and locked into the interior of the female housing 1. In locking, the front holder 2 is fitted once in a temporarily locked state and, thereafter, is fitted in an actually locked state in a specific operation process. The female terminal 4 to be stored and fixed to the female housing 1, in the actually locked state, is fixed to the interior of the female housing 1 but, in the temporarily locked state, is not fixed.

The female housing 1 is formed of, for example, synthetic resin and includes a terminal storing chamber 7 and a hood part 6 formed to cover the outer periphery of the terminal storing chamber 7.

The terminal storing chamber 7 is defined by a storing chamber outer wall 20 and is opened on the front and back sides. The storing chamber wall 20 has a substantially rectangular tube shape, while the terminal storing chamber 7 is arranged inside the wall 20. A packing 3 formed of elastic material such as silicone rubber is mounted on the side surface of the back side of the wall 20 (that is, on the deep side of a connector storing opening 60). And, the front holder 2 is mounted on the portion existing forwardly of the packing 3 in such a manner that it is fitted therein.

The periphery of the terminal storing chamber 7 is covered by a substantially rectangular tube-shaped hood part 6. The front end of the hood part 6 is projected forwardly of the front end of the terminal storing chamber 7. And, there is formed a connector storing opening 60 through which a male connector (not shown) serving as a mating connector can be inserted. Here, in this embodiment, the terminal storing chamber 7 is formed in two stages in the vertical direction and in 10 locations in the horizontal direction. The female terminal 4 is inserted into the terminal storing chamber 7.

One side surface of the hood part 6 is partially cut out penetratingly in the thickness direction and, inside the cut-out portion, there is provided an elastic locking piece (lock arm 5) for locking the male connector inserted.

Inside the storing chamber outer wall 20 defining the terminal storing chamber 7, there is formed a cantilever housing lance 8 extending forward and slightly downward from the upper wall surface and a wall surface partitioned in two vertical stages. The front end portion of the housing lance 8 can be elastically deformed to approach the upper surface. The housing lance 8 fixes the female terminal 4 inserted into the terminal storing chamber 7.

The female terminal 4 is formed, for example, by pressing a conductive metal plate, and includes in the front end thereof a connecting portion formed as a substantially rectangular tube and in the rear end thereof a caulking portion having a substantially U-shaped section to be caulked to the core wire and coating of an electric wire. In one side surface (here, upper side surface) of the connecting portion, there is formed a specifically shaped opening into which the housing lance 8 can be fitted.

For example, as shown in FIG. 3, in a specific position of the front surface 20*a* of the storing chamber outer wall 20, more specifically, in an area existing centrally in the horizontal direction and above the upper stage side terminal storing chamber 7, there is formed a locking structure for locking the front holder 2 (housing side locking structure 70). A holder side locking structure 80 (to be discussed later) is to be locked on the housing side locking structure 70. A structure for locking the housing side locking structure 70 and holder side locking structure 80 is described later.

The front holder 2 is formed of, for example, synthetic resin, and includes a holder front wall surface 2*a* and a holder side wall 2*c* extended backward from the peripheral edge of the holder front wall surface 2*a* and externally fitted with the front end of the terminal storing chamber 7 of the female housing 1.

The holder front wall surface 2*a* has openings 2*b* (insertion holes) formed in two vertical stages corresponding to the terminal storing chamber 7.

On the back side of the holder front wall surface 2*a*, that is, on the inner side of the front holder 2, there is extended a plate-shaped detection plate 12 facing backward. The detection plate 12 is formed according to the number of the terminal storing chambers 7. The detection plate 12 is to be inserted into a bending space 28 when the front holder 2 is actually locked on the front end of the terminal storing chamber 7.

Also, in a specific area on the back side of the holder front wall surface 2*a*, there is formed a holder side locking structure 80. Here, the holder side locking structure 8 is formed in a horizontally central upper side portion.

Here, referring to FIG. 5, description is given specifically of a structure for locking the housing side locking structure 70 and holder side locking structure 80.

In the front surface 20*a* of the storing chamber outer wall 20, there is formed a locking hole 71 recessed backward with a specific depth. A temporarily locking piece 74 and an actually locking piece 75 extend forward from the bottom surface of the locking hole 71. The temporarily locking piece 74 has a temporarily locking projection 9. The temporarily locking projection 9 has a key-shaped section facing toward the actually locking piece 75. Similarly, the actually locking piece 75 has an actually locking projection 10. The actually locking projection 10 has a key-shaped section facing toward the temporarily locking piece 74. Here, the temporarily locking projection 9 is formed forwardly of the actually locking projection 10 in FIG. 5.

On the back side of the front holder 2, as described above, there is formed the holder side locking structure 80. The holder side locking structure 80 includes a backward extending locking piece 82 and guide pieces 81, 83 respectively formed on the two sides of the locking piece 82.

The locking piece 82 is inserted between the temporarily locking piece 74 and actually locking piece 75 of the housing side locking structure 70. Here, the locking piece 82 has a temporarily locking projection 13 and an actually locking projection 14. The temporarily locking projection 13 has a key-shaped section projecting toward the temporarily locking piece 74 (to the left in FIG. 5). The actually locking projection 14 has a key-shaped section projecting toward the actually locking piece 75 (to the right in FIG. 5). The temporarily locking projection 13 is formed nearer to the tip end than the actually locking projection 14.

Also, the guide piece 81 shown on the left in FIG. 5 is inserted into the locking hole 71 so as to cover the outside (in FIG. 5, the left side) of the temporarily locking piece 74. The guide piece 83 shown on the right is inserted into the locking hole 71 so as to cover the outside (in FIG. 5, the right side) of the actually locking piece 75.

In the temporarily locked state, the temporarily locking projection 13 has advanced deep beyond the temporarily locking projection 9 and the actually locking projection 14 of the locking piece 82 is contacted with the actually locking projection 10 of the actually locking piece 75. To provide the actually locked state, the actually locking projection 14 must go beyond the actually locking projection 10. Here, to transfer the temporarily locked state to the actually locked state, the front holder 2 must be pushed further deeper; and, in this operation, an operator may push in the front holder 2 itself, or when mounting a mating connector, the mating connector may push in the front holder 2 with such mounting operation.

Here, as shown in FIG. 6, the front holder 2 has a bottom face backlash preventive projection 15 and a side surface backlash preventive projection 16.

Figure 7A:
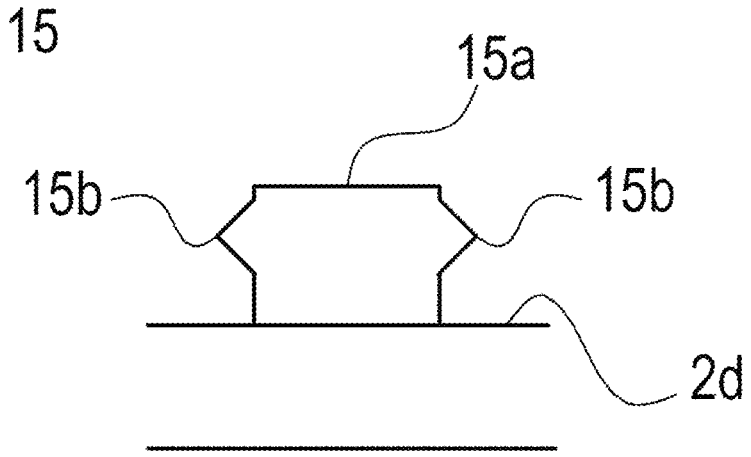
FIG. 7A is an enlarged view of the area W1 of FIG. 6, and FIGS. 7B and C are enlarged views of the areas W2 of FIG. 6 according to the embodiment.
Figure 7B:
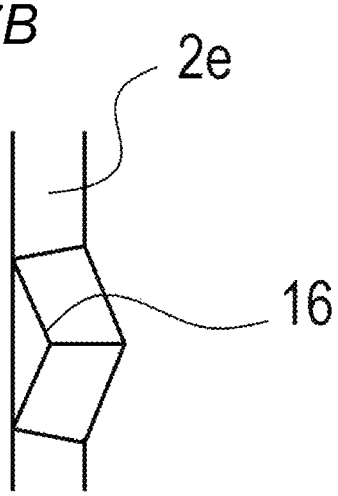
Figure 7C:
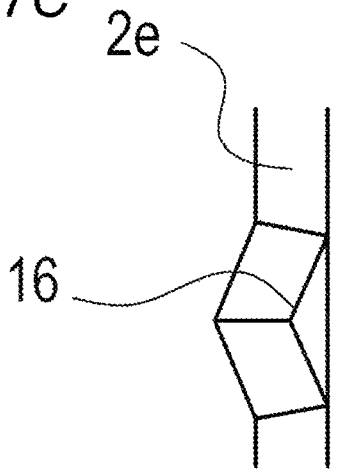
Figure 8:
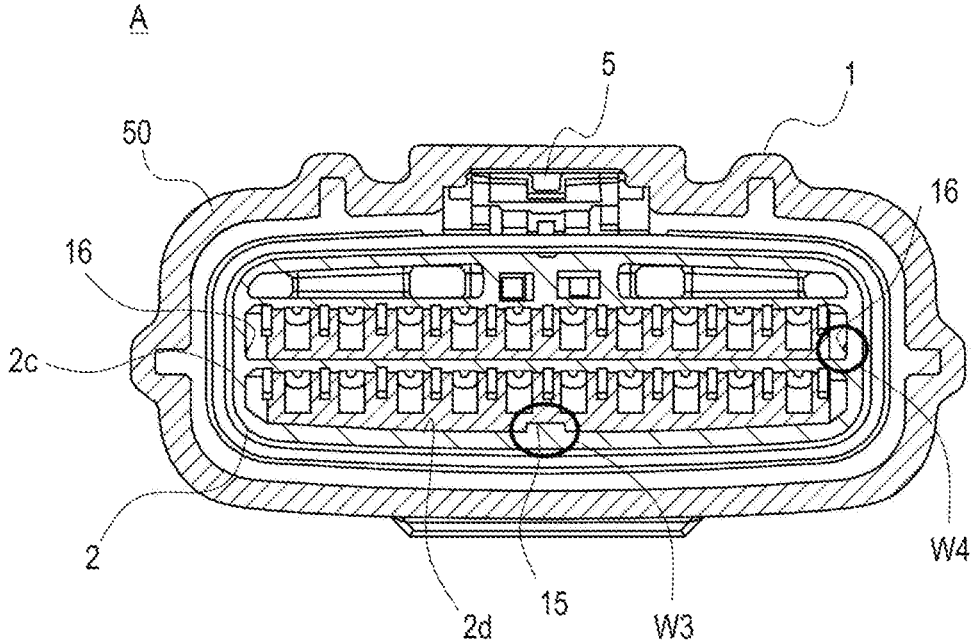
FIG. 8 is a transverse section view of a temporarily locked female connector in a specific position according to the embodiment.
Figure 9:
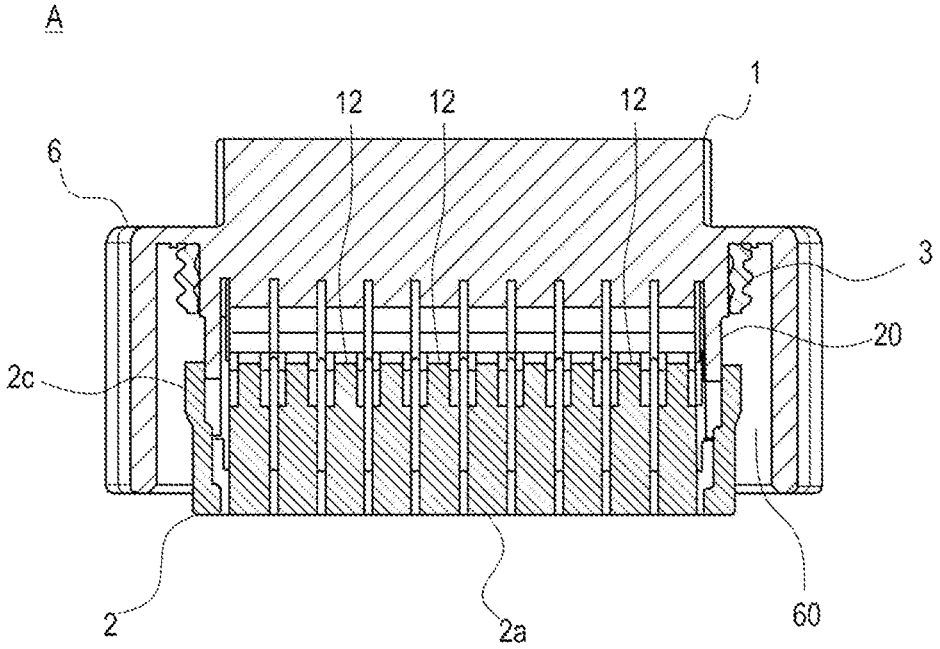
FIG. 9 is a horizontal section view of a temporarily locked female connector in the specific position according to the embodiment.
Figure 10A:
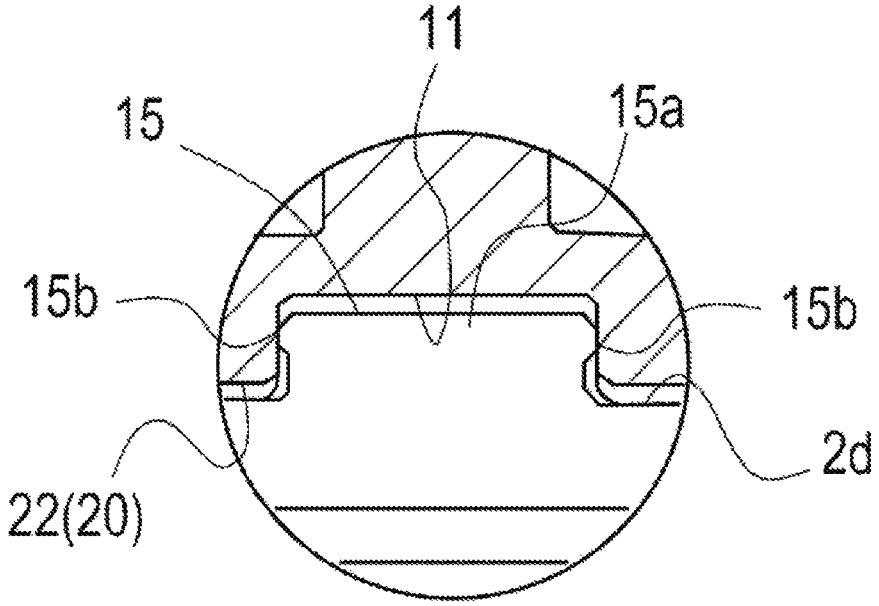
FIG. 10A is an enlarged view of the area W3 of FIG. 8.
Figure 10B:
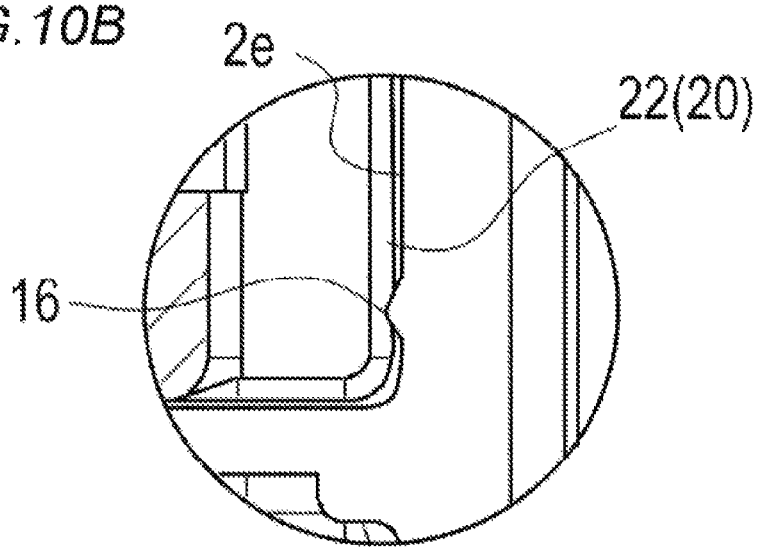
FIG. 10B is an enlarged view of the area W4 of FIG. 8 according to the embodiment.

FIG. 7A to 7C show enlarged views of areas W1 and W2 shown in FIG. 6. FIG. 7A is an enlarged view of the area W1, with the bottom face backlash preventive projection 15 shown enlargedly. FIG. 7B is an enlarged view of the area W2, while the side surface backlash preventive projection 16 on the left side of FIG. 6 is shown enlargedly. FIG. 7C is an enlarged view of an area W3, while the side surface backlash preventive projection 16 on the right side of FIG. 6 is shown enlargedly. FIG. 8 shows a transverse section of a female connector A with the temporarily locked front holder 2 fitted therein. FIG. 9 shows a horizontal section of the female connector A with the temporarily locked front holder 2 fitted therein. This shows a portion where the detection plate 12 is formed in the front holder 2. FIG. 10A shows enlargedly an area W3 of FIG. 8, and FIG. 10B shows enlargedly an area W4 of FIG. 8.

The bottom face backlash preventive projection 15 is provided on the center of the lower inner wall surface 2*d* of the front holder 2 so as to project upward. It includes a convex-shaped main body 15*a* and two pressing parts 15*b* respectively projecting on the two sides of the main body with a triangular section. As shown in FIG. 10A, the bottom face backlash preventive projection 15, in the temporarily locked state, fits into a groove 11 formed in a specific area of the storing chamber outer wall 20. In this case, the pressing parts 15*b* are pressed into the groove 11 and are slightly collapsed.

The side surface backlash preventive projection 16 is formed at two locations opposed to a specific position (here, a vertically, substantially central position) of the lateral inner wall 2*e* of the front holder 2. As shown in FIG. 10B, the side surface backlash preventive projection 16 is contacted with a holder fitting part 22 and is slightly collapsed. Here, for illustration convenience, FIGS. 10A and 10B show states before it is collapsed.

Next, description is given of how to assemble the female connector A. Firstly, the packing 3 is mounted on the packing arrangement portion 21 of the storing chamber outer wall 20 of the female housing 1. After then, the front holder 2 is temporarily locked on the front end of the terminal storing chamber 7.

The temporary locking of the front holder 2, as described above, is performed by the deep advancement of the temporarily locking projection 13 beyond the temporarily locking projection 9.

Figure 11:
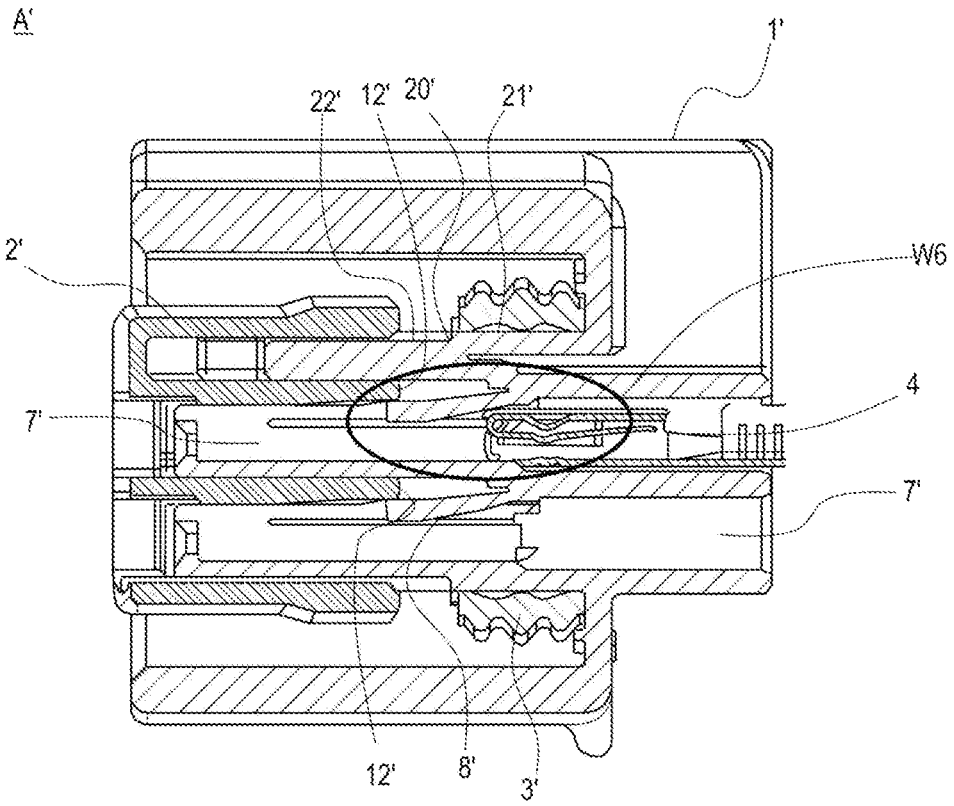
FIG. 11 is a longitudinal section view of a temporarily locked female connector in a specific position according to the embodiment.
Figure 12:
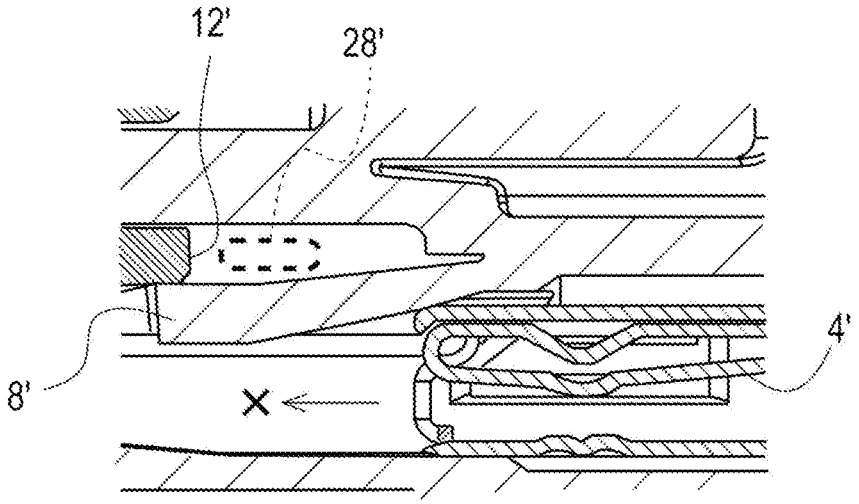
FIG. 12 is an enlarged view of the area W5 of FIG. 11 according to the embodiment.
Figure 13:
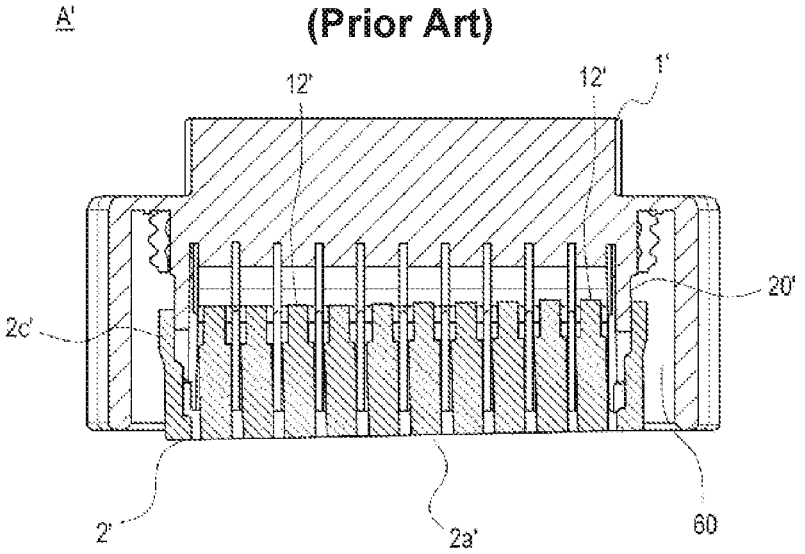
FIG.13 (Prior Art)
FIG. 13 is a horizontal section view of a temporarily-locked backlashing female connector in a specific position according to a related art.

Here, FIG. 11 shows a longitudinal section of the female connector A with the front holder 2 temporarily locked. FIG. 12 shows an area W5 of FIG. 11 enlargedly. FIG. 13 shows a horizontal section of the female connector A with the front holder 2 temporarily locked.

As shown in these figures, in the temporarily locked state, the detection plate 12 of the front holder 2 is not inserted into the bending space 28 of the female housing 1. Thus, the housing lance 8 is elastically deformable. In this state, the female terminal 4 with an electric wire caulked and fixed thereto is inserted into the terminal storing chamber 7 from behind.

With insertion of the female terminal 4 into the terminal storing chamber 7, the tip end of the female terminal 4 is contacted with the lower surface of the housing lance 8 and the female terminal 4, while elastically deforming the housing lance 8 upward, advances further into the terminal storing chamber 7. When the female terminal 4 reaches a normal position within the terminal storing chamber 7, the housing lance 8 recovered from elastic deformation fits into the upper surface opening of the female terminal 4.

Figure 14:
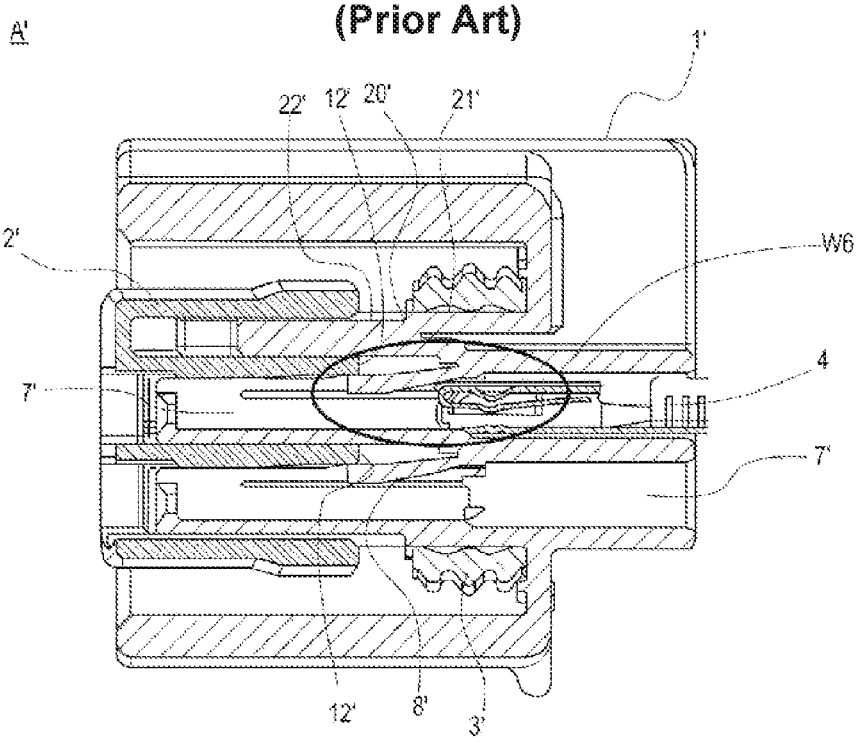
FIG.14 (Prior Art)
FIG. 14 is a longitudinal section view of the temporarily-locked backlashing female connector in the specific position according to the related art.
Figure 15:
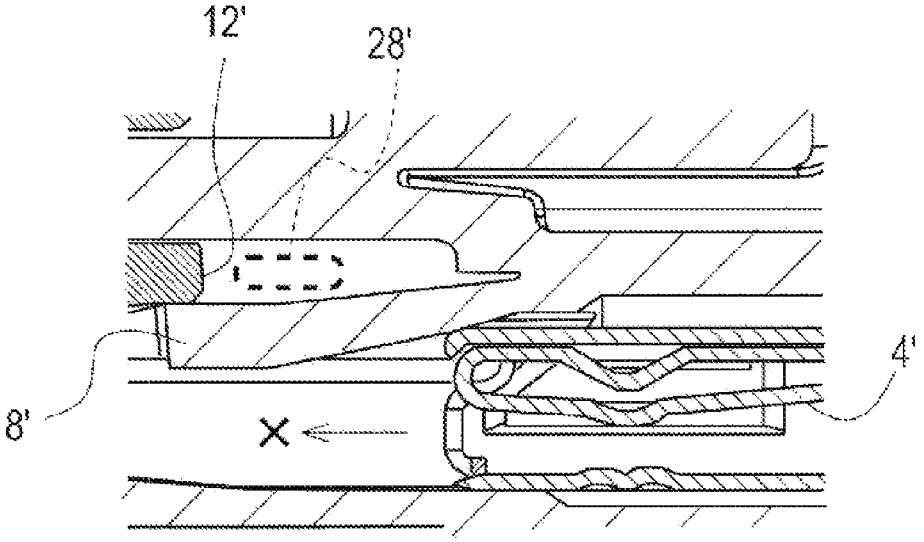
FIG. 15 is enlarged view of the area W6 of FIG. 14 according to the related art.

Here, supposing the above-mentioned bottom face backlash preventive projection 15 and side surface backlash preventive projections 16 are absent, when the front holder 2 is temporarily locked, as shown in FIGS. 13-15, the front holder 2 can backlash. Here, the front holder 2 and storing chamber outer wall 20 are temporarily locked together by the above-described housing side locking structure 70 and holder side locking structure 80. However, in the locking structure of FIG. 5, with the contact position P1 between the actually locking projection 14 of the locking piece 82 and the actually locking projection 10 of the actually locking piece 75 as a fulcrum, as shown by arrows, there can occur rotating backlash. In this case, in the backlashing female connector A' of FIG. 13, as it goes to the right in FIG. 13, the detection plate 12' advances deeper. Thus, as shown in FIGS. 14 and 15, in spite of the temporarily locked state, the detection plate 12' advances into a bending space 28'. As a result, the housing lance 8' is disabled to deform elastically, thereby disabling insertion of the female terminal 4.

However, in this embodiment, due to provision of the groove 11, bottom face backlash preventive projection 15 and side surface backlash preventive projections 16, when the front holder 2 and storing chamber outer wall 20 are temporarily locked, their attitudes can be maintained properly. This can avoid occurrence of backlash. Also, existence of the bottom face backlash preventive projection 15 and side surface backlash preventive projections 16 can increase the transfer power to transfer the temporarily locked state to the actually locked state. Thus, in transportation or the like of the temporarily locked female connector A, it can be prevented from being transferred to the actually locked state due to vibrations, contact with other parts, or the like.

The invention has been described heretofore with reference to the embodiment thereof. However, the embodiment is an example and thus it can be understood by persons skilled in the art that the composing elements thereof and the combinations thereof can be modified variously and such modifications also fall under the scope of the invention.

DESCRIPTION OF REFERENCE NUMERALS AND SIGNS

A: female connector
1: female housing
2: front holder
2*a*: holder front wall surface
2*b*: opening
2*c*: holder side wall
2*d*: lower inner wall
4: female terminal
5: lock arm
6: hood part
7: terminal storing chamber
8: housing lance
9: temporarily locking projection
10: actually locking projection
11: groove
12: detection plate
13: temporarily locking projection
14: actually locking projection
15: bottom face backlash preventive projection
16: side surface backlash preventive projection
20: storing chamber outer wall
22: holder fitting part
60: connector storing opening
70: housing side locking structure
74: temporarily locking piece
75: actually locking piece
80: holder side locking structure
82: locking piece
81, 83: guide piece.

What is claimed is:

1. A connector, comprising:
a connecting terminal;
a connecting housing; and
a front holder,
wherein the connecting housing comprises:
a connecting terminal storing chamber for storing the connecting terminal; and
a lance which is elastically deformable in order to store the connecting terminal into the terminal storing chamber and, which is engageable with the connecting terminal in order to prevent the connecting terminal stored in the terminal storing chamber from removing in an opposite direction to an insertion direction by recovering from an elastic deformation,
wherein the front holder is supported to be movable to back and forth along the insertion direction, and the front holder is locked on a front end of the terminal storing chamber,
wherein the front holder is configured to move relative to the connecting housing from an intermediate position, in which the front holder is in a state of being temporarily locked, in the opposite direction to the insertion direction to a final position, in which the front holder is in a state of being actually locked by pressure, and the front holder is configured to contact with the connecting terminal to hold the connecting terminal between the front holder and the lance in a state that the front holder is actually locked,
wherein the connector further comprises:
a locking structure which locks the front holder to the connector housing in the intermediate position and in the final position to prevent movement of the front holder in the insertion direction relative to the connector housing in the intermediate position and in the final position; and
an attitude maintaining structure which maintains the relative attitudes of the front holder and the connector housing in the intermediate position to prevent rotation of the front holder relative to the connector housing about the locking structure in the intermediate position,
wherein the attitude maintaining structure comprises a pressing projection formed in any one of the front holder and the connector housing,
wherein the pressing projection is pressed against the other of the front holder and the connector housing with the front holder in the intermediate position
wherein the attitude maintaining structure comprises:
a groove formed in any one of the front holder and the connector housing; and
a fitting projection formed in the other of the front holder and the connector housing and capable of fitting into the groove in the intermediate position or the final position, and
wherein the fitting projection is slightly collapsed in the intermediate position.

2. The connector according to claim 1, wherein the attitude maintaining structure impedes movement of the front holder from the intermediate position to the final position.

3. The connector according to claim 1, wherein the attitude maintaining structure comprises a pressing projection formed in any one of the front holder and the connector housing,
wherein the pressing projection is pressed against the other of the front holder and the connector housing with the front holder in the intermediate position.

* * * * *